US007161086B2

(12) United States Patent
Torcivia et al.

(10) Patent No.: US 7,161,086 B2
(45) Date of Patent: Jan. 9, 2007

(54) PORTABLE ELECTRONIC INFORMATION AND/OR ENTERTAINMENT RENDERING DEVICES CARRIER

(75) Inventors: Wayne M. Torcivia, 60 Creighton Ave., Ronkonkoma, NY (US) 11779; Leonardo A. Santana, Ronkonkama, NY (US)

(73) Assignee: Wayne M. Torcivia, Ronkonkoma, NY (US)

( * ) Notice: Subject to any disclaimer, the term of this patent is extended or adjusted under 35 U.S.C. 154(b) by 0 days.

(21) Appl. No.: 10/994,807

(22) Filed: Nov. 22, 2004

(65) Prior Publication Data

US 2006/0108141 A1 May 25, 2006

(51) Int. Cl.
*H01B 7/00* (2006.01)

(52) U.S. Cl. ..... 174/135; 455/575.6; 455/575.1

(58) Field of Classification Search ..... 206/340; 455/575.6, 575.1; 174/135
See application file for complete search history.

(56) References Cited

U.S. PATENT DOCUMENTS

| | | | | |
|---|---|---|---|---|
| 6,983,169 | B1 * | 1/2006 | Vogel et al. | 455/550.1 |
| 2004/0013279 | A1 * | 1/2004 | Takeda | 381/312 |
| 2004/0058719 | A1 * | 3/2004 | Condiff | 455/575.1 |
| 2004/0070499 | A1 * | 4/2004 | Sawinski | 340/568.1 |
| 2004/0087335 | A1 * | 5/2004 | Peiker | 455/556.2 |
| 2004/0204204 | A1 * | 10/2004 | Brilliant et al. | 455/575.1 |
| 2005/0192045 | A1 * | 9/2005 | Lowles | 455/550.1 |

* cited by examiner

*Primary Examiner*—Hung V. Ngo
(74) *Attorney, Agent, or Firm*—Wayne M. Torcivia; Leonardo A. Santana

(57) ABSTRACT

It is a carrier for portable electronic information and/or entertainment rendering devices. The carrier engages the contour(s) and/or edge(s) of the aforementioned devices and by means of frictional surface forces prevents slippage. It is an attacheable and detacheable carrier. The carrier attaches to the portable information and/or entertaiment rendering devices by means of hooks and frictional force. The carrier attaches to the user by means of a spring-loaded hook.

10 Claims, 7 Drawing Sheets

PORTABLE ELECTRONIC INFORMATION AND/OR ENTERTAINMENT RENDERING DEVICES CARRIER

BACKGROUND OF THE INVENTION

Figure 1:
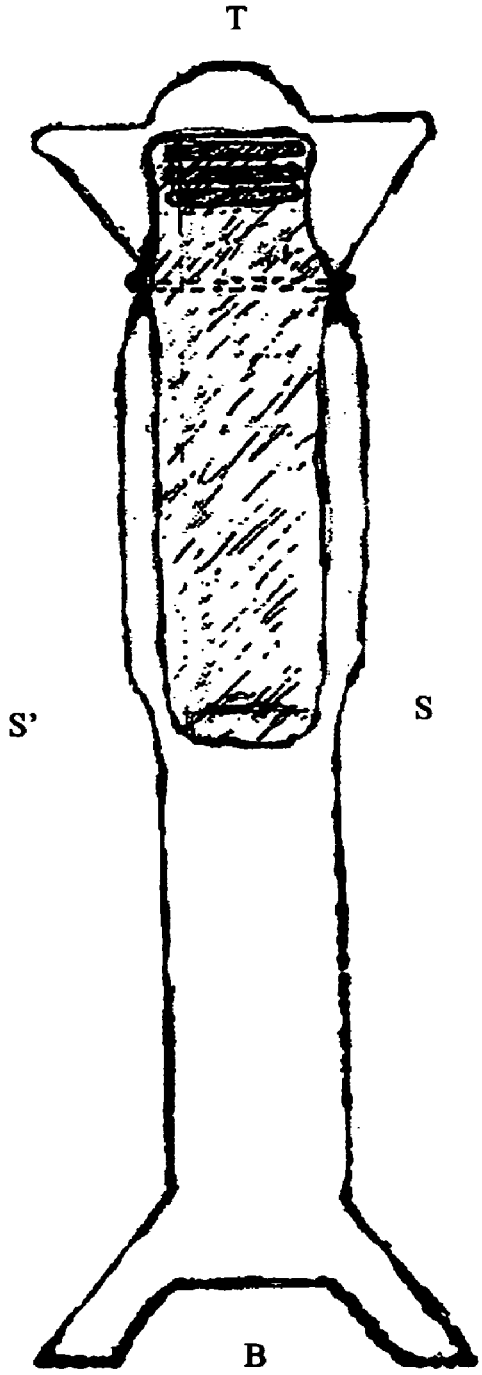

Portable compact disc players and/or other media playing devices, pocket computers, dedicated game consoles and wearable computers are very convenient and useful electronic devices to have for the convenience of enjoying a diverse universe of entertainment and information wherever and whenever the user wants to do so; However, We have found that the great majority of O.E.M. have neglected to include with the aforementioned devices, a convenient and safe way to carry them.

The method we have devised allows the user to carry the portable electronic information and/or entertainment rendering devices in a safe, convenient and reliable way. This method is safe for both the user and the device. The user does not have to become entangled with any hanging straps, ropes, strings, wires or too many hooks, . . . , etc. The portable information and/or entertainment rendering device is kept safe from falling to the ground and being damaged or totally destroyed. We have tested this carrier in several environments to make sure that the assertions we make, herein, are true.

The convenience of the carrier refers to its seamlessness, ease and intuitive utilization. The user will attach the carrier to the portable electronic information and/or entertainment rendering device and then clip it to himself/herself around the waistband, shirt pocket, pants pockets, blouse or shirt collar, back of the blouse or shirt collar, . . . , wherever there is a contour to hook up with.

The reliability of the carrier comes from the geometrical structure of it and the type of materials we used to manufacture it. The materials we used allow for maximum flexibility, elasticity and strength. The carrier can be attached and detached, respectively, on and off the portable electronic information and/or entertainment rendering devices.

We have already created a working prototype; it can be attached and detached at will to and from several models of portable compact disc players we have tested, from a particular manufacturer. We have tested its reliability by going to gymnasiums, running in tracks, going shopping, . . . , etc. So far, we have not had an accidental detachment event, yet.

BRIEF SUMMARY OF THE INVENTION

In summary, the device is an attacheable and detacheable carrier for portable electronic information and/or entertainment rendering devices without a built-in attachment clip (see definitions below).

Which device the carrier will mate with is determined at the time of manufacture; depending on the particular device, model and manufacturer, a small modification on the upper and lower portions of the carrier and decreasing/increasing its longitudinal length will make it engage the particular portable electronic information and/or entertainment rendering device.

We consider the following electronic devices and any combination thereof, to be portable electronic information and/or entertainment rendering devices:

Definitions:

1. portable compact disc players with/without (digital/analog) radio receiver.

2. portable electronic media rendering devices (digital video/digital audio regardless of format).
3. portable digital video disc players with/without wearable display and/or with/without terrestrial/satellite (digital/analog) television receiver.
4. portable (digital/analog) terrestrial/satellite television receiver with/without wearable display.
5. portable (digital/analog) satellite radio receiver.
6. portable (digital/analog) terrestrial radio receiver.
7. portable (digital/analog) terrestrial radio transceiver.
8. portable dedicated electronic game consoles.
9. pocket computers.
10. wearable computers.

Figure 2:
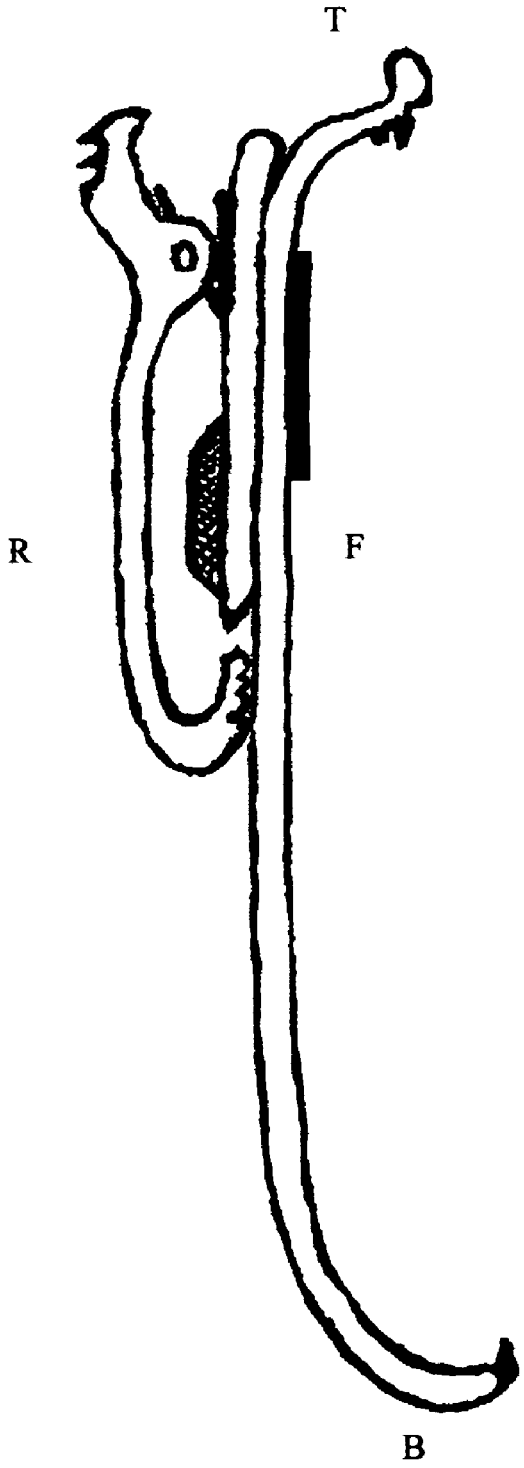
Figure 3:
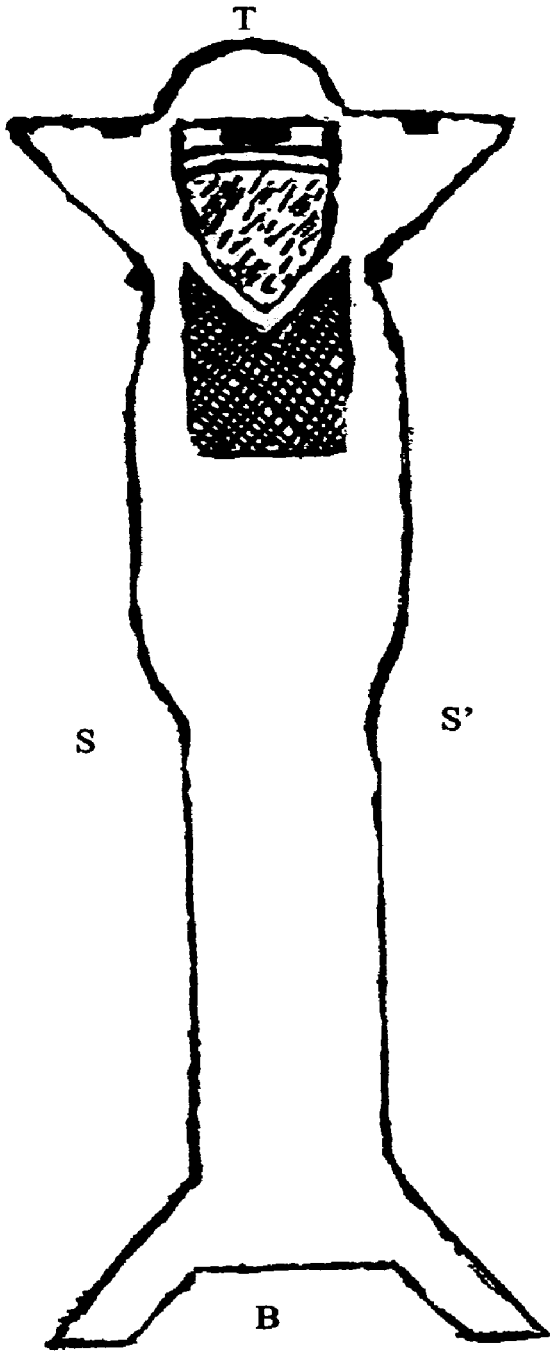
Figure 4:
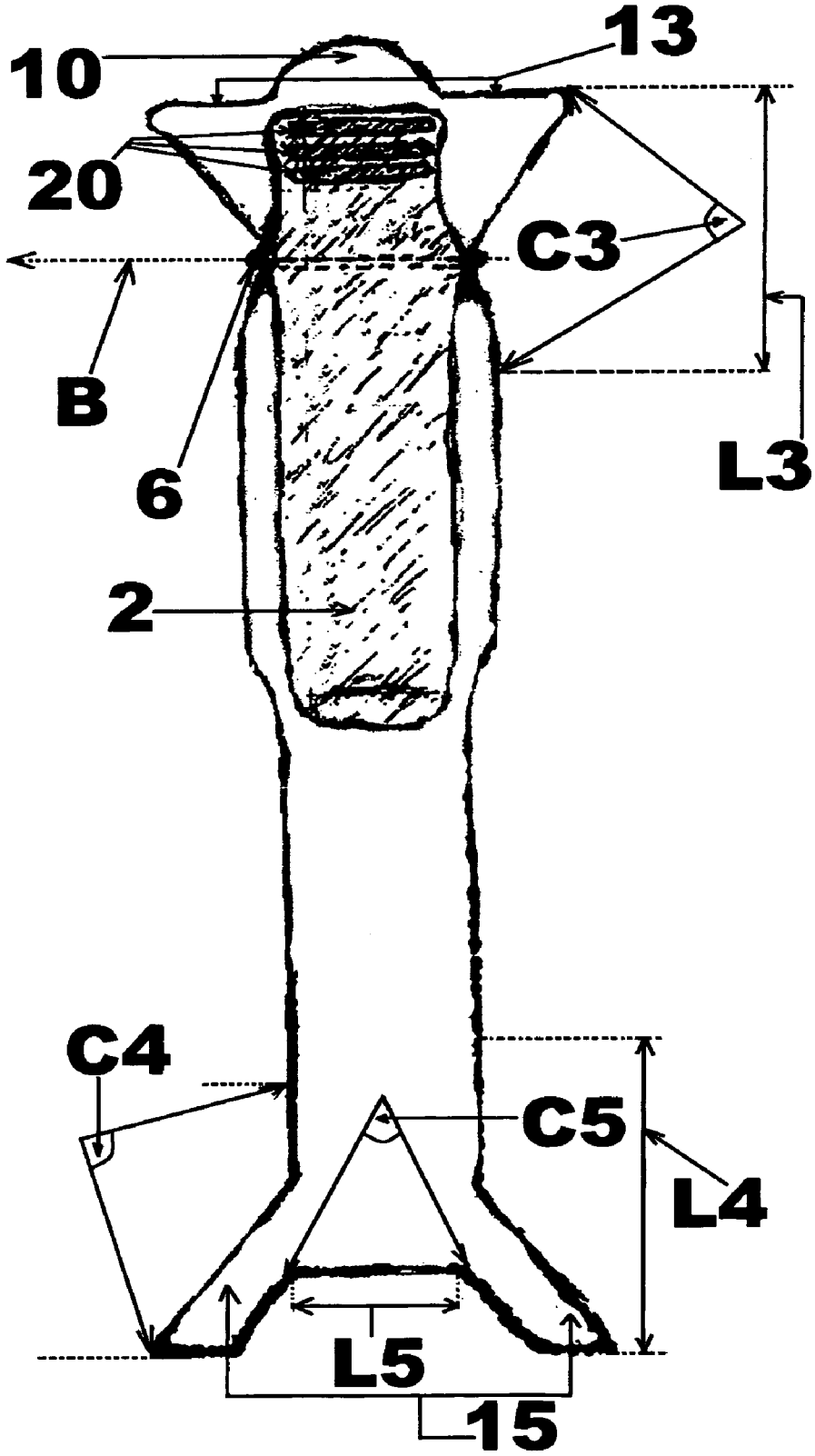
Figure 5:
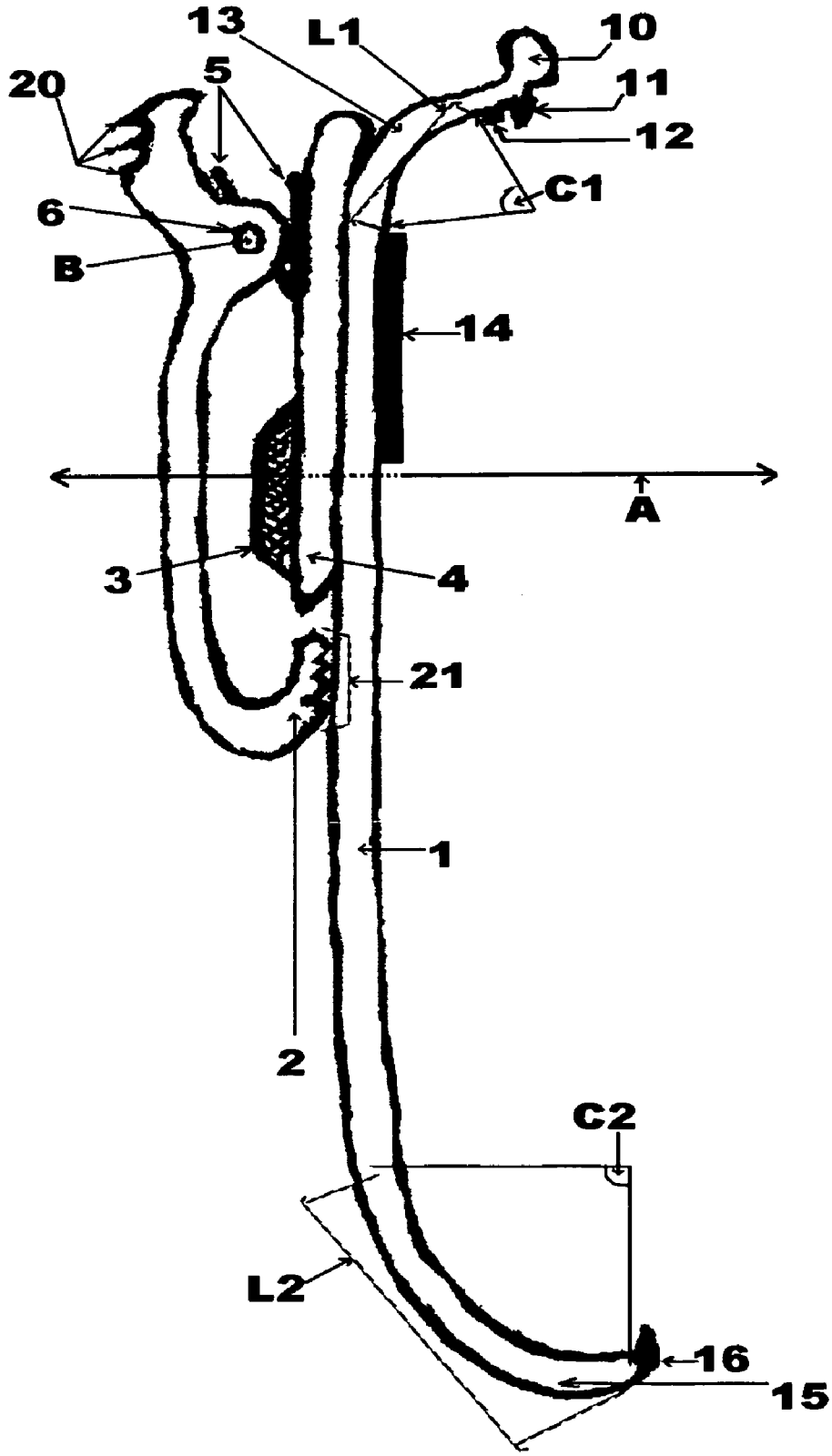
Figure 6:
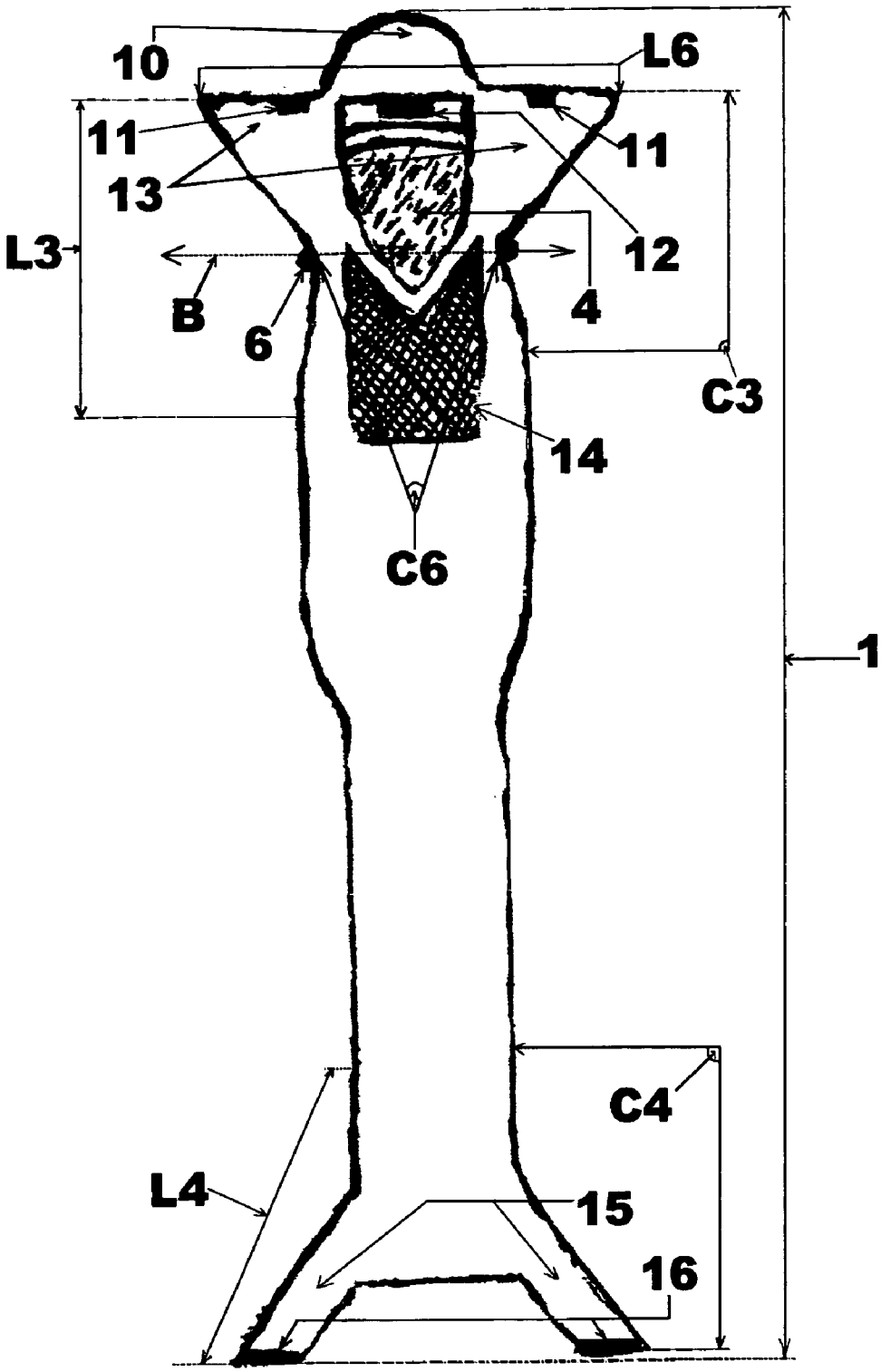
Figure 7:
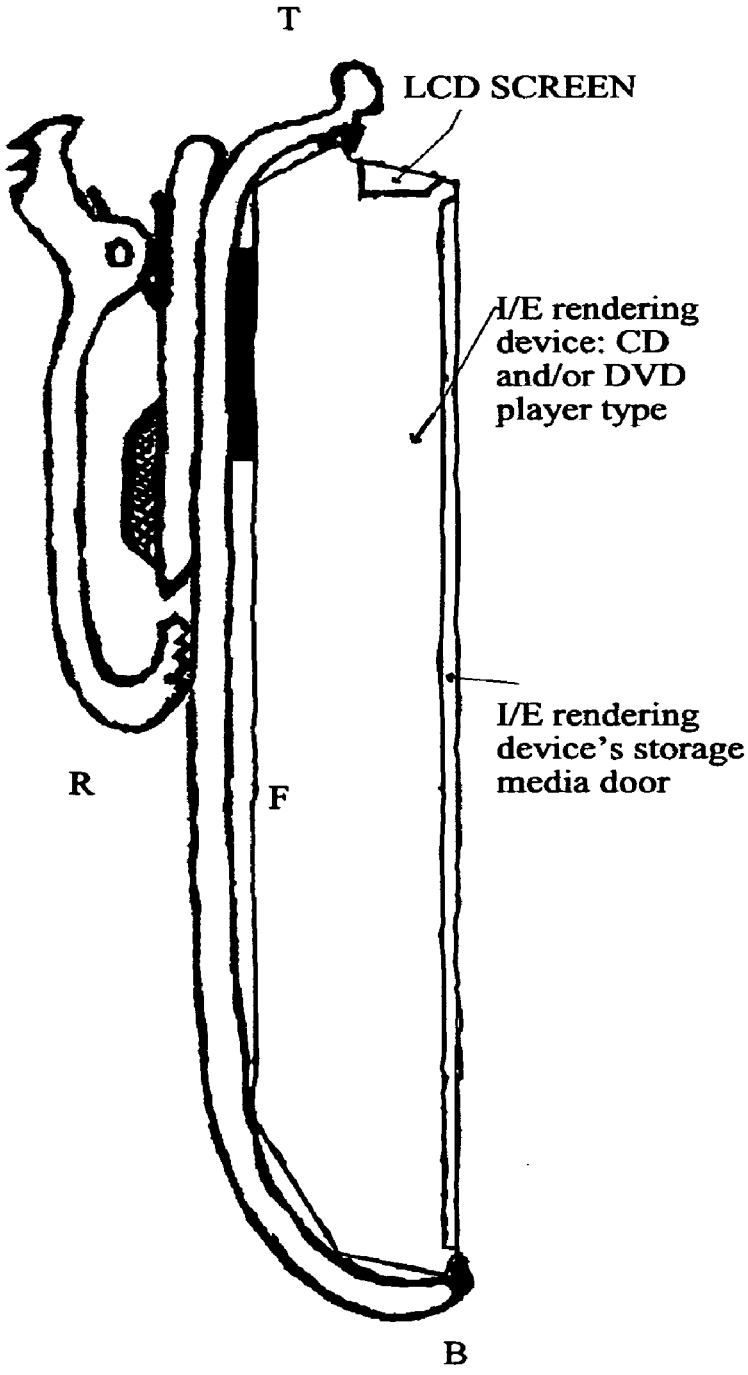

Drawing Point of View Descriptive Statement:

THE VIEWS: (BRIEF DESCRIPTION)

a. FIG. 1: REAR b. FIG. 2: LATERAL (RIGHT and LEFT, SYMMETRICAL)

c. FIG. 3: FRONT d. FIG. 4: REAR (with parts named)

e. FIG. 5: LATERAL (RIGHT and LEFT, SYMMETRICAL with parts named)

f. FIG. 6: FRONT (with parts named)

g. FIG. 7: ENGAGEMENT (LATERAL PERSPECTIVE)

DESCRIPTIVE GEOMETRY: (BRIEF DESCRIPTION)

Axes definitions and reference points are as follows:

1. The TOP-BOTTOM axis is denoted and spanned by the upper case symbol T (reference point for TOP) and upper case letter B (reference point for BOTTOM).
2. The FRONT-REAR axis is denoted and spanned by the upper case symbol F (reference point for FRONT) and upper case symbol R (reference point for REAR).
3. The SIDE-SIDE axis is denoted and spanned by the upper case symbol S (reference point for SIDE 1) and upper case symbol S' (reference point for SIDE 2).

In FIG. 1 and FIG. 4, the carrier prototype for compact disc players is shown from a rear perspective. The most important parts are shown, respectively. The upper case letter T indicates the top of the carrier and the lower case letter B indicates the bottom of the carrier.

In FIG. 2 and FIG. 5, the compact disc player carrier prototype is shown from a lateral approach. The carrier is symmetrical alongside its TOP-BOTTOM axis, hence only one of the two possible lateral views is shown.

In FIG. 3 and FIG. 6, the carrier prototype for portable compact disc players is shown from a frontal approach. The carrier prototype for portable compact disc players has no symmetry alongside its FRONT-REAR or SIDE-SIDE axis.

In FIG. 7, the carrier prototype for portable compact disc players is shown engaging an actual portable compact disc player. It can be noted, that the carrier engages the compact disc player in an unobstrussive manner and allows the physical media to be placed into and removed from the portable compact disc player (an information and/or entertainment rendering device).

DETAILED DESCRIPTION OF THE INVENTION

As it applies to all information contained herein, we are defining as portable electronic information and/or entertainment rendering devices the following:

1. portable compact disc players with or without terrestrial/satellite (digital/analog) radio receiver.
2. portable electronic media rendering devices (digital video/digital audio regardless of format).
3. portable digital video disc players with/without wearable display and/or with/without terrestrial/satellite (digital/analog) television receiver.
4. portable (digital/analog) terrestrial/satellite television receiver with/without wearable display.
5. portable (digital/analog) satellite radio receiver.
6. portable (digital/analog) terrestrial radio receiver.
7. portable (digital/analog) terrestrial radio transceiver.
8. portable dedicated electronic game consoles.
9. pocket computers
10. wearable computers Drawings alpha-numeric parts list and descriptions as applicable to FIGS. 4, 5 and 6 is as follows: device interface body (1), user engagement hook body (2), hook base swiveling fulcrum (3), user engagement hook body base (4), user engagement hook body spring (5), user engagement hook body fulcrum (6), not assigned (7), (8), (9); tension release tab (10), set of upper primary device engagement hooks (11), set of upper secondary device engagement hooks (12), set of upper device engagement arms (13), device friction rubber retainer (14), set of lower device engagement arms (15), set of lower device engagement hooks (16), not assigned (17), (18), (19); user operation friction surfaces (20), user engagement hook friction surfaces (21), upper device engagement arms curvature angle (C1), upper device engagement arms curvature length (L1), lower device engagement arms curvature angle (C2), lower device engagement arms curvature length (L2), the upper lateral angle (C3) between (13) and (15), the upper lateral curvature length (L3) between (13) and (15), the lower lateral angle (C4) between (13) and (15), the lower curvature length (L4) between (13) and (15), the angle (C5) between (15), the curvature length (L5) between (15), the gangle (C6) between (13), the curvature length (L6) between (13), hook body base swiveling fulcrum axis of rotation (A) and user engagement hook body fulcrum axis of rotation (B).

The carrier device is designed to be attached or detached at will and with ease on/off the portable electronic information and/or entertainment rendering devices; This in turn allows the user to carry and use the aforementioned devices attached to his/her belt, pant pockets, shirt pockets, T-shirt neck, pant or skirt waistline, purse pocket, carrying case pocket, etc. With very small modifications at the upper and lower portions of the carrier and its longitudinal length, it can be mated to many different types of portable electronic information and/or entertainment rendering devices. The initial prototype, was meant to mate with a specific compact disc player model from one particular manufacturer; soon we realized that we could use the carrier with other compact disc players from that same manufacturer. In addition, we realized that by making slight changes on the upper and lower engaging points of the carrier, we can mate the carrier to other compact disc players and other media playing devices from the same and other manufacturers. Furthermore, we realized that the carrier could be modified easily to mate to portable electronic dedicated game consoles, pocket computers and wearable computers.

In this manner, the user of the portable electronic information and/or entertainment rendering device, can enjoy the use of the device without the hassle of hanging strings and/or straps. Furthermore, the worry of accidental damage to the portable electronic information and/or entertainment rendering device due to an accidental fall is greatly minimized regardless of the activity in which the user is involved. The carrier device is very unobstrussive. Furthermore, we have personally tested the carrier device on a physical fitness center setting. We have done the following while wearing the carrier device on our fitness pants carrying number #1 (see "Tested Compact Disc Players and Other Media Playing Devices").

What is new and different with this portable electronic information and/or entertainment rendering device carrier is that it allows the user to change the media without unbuttoning or unstrapping anything. Furthermore, the user is able to carry the portable electronic information and/or entertainment rendering device anywhere on his/her body where there is a closed loop-like topology. Furthermore, is light weight, compact and unobstrussive. and/or entertainment rendering devices is not by engolfing them in a protective "pouch", but by engaging the built-in edges, crevices and contours (when available) on the portable electronic information and/or entertainment rendering devices. The "carrier" uses small hooks and frictional surface forces to attach itself to the portable electronic information and/or entertainment rendering devices, thus preventing accidental detachment and slippage.

Mode of Engagement:

Portable Electronic Information and/or Entertainment Rendering Device Type:

Portable Compact Disc Players

Pick up the carrier by its back on one hand and then pick up the compact disc player and/or other media playing device with the other hand. Bring the back of the compact disc player and/or other media playing device in front of the carrier. Now, engage the bottom hooks of the carrier with the lower edge(s) and/or contour(s) of the compact disc player and/or other media playing device. When this engagement has been achieved, Now, proceed to engage the top of the compact disc player and/or other media playing device with the top of the carrier; now, proceed to push the compact disc player and/or other media device upper edges and/or contour (s) towards the upper double row of hooks; when the double "clicking" sound is heard, full engagement has been achieved. These procedures were tested with the working prototype as it applies to the compact disc players and/other media playing devices as described in:

"Tested Compact Disc Players and Other Media Playing Devices".

Tested Activities and Environments:

Indoors:

Thread Mill, Weight Lifting, Frontal Crunches, Lateral Crunches, Circuit Running, Office work, Warehouse work, Auto repair shop, Light manufacturing, Sitting, Walking.

Outdoors:

Jogging, Running, Bicycling, Fishing(*), Walking, Hiking, Skiing, Roller-Blading, Skating, Motorbicycle racing (Track/Field), Mountain climbing, Surfing(*), Boating(*), Water Skiing(*), Skateboarding.

(*) The compact disc player and/or other media devices must be protected against water damage.

Tested Compact Disc Players and Other Media Playing Devices:

1. SONY(®) "Car Ready Walkman" with G-Protection
   [Model Name: CD WALKMAN Model Number: D-EJ368CK]
   Manufacturer Address:
   Sony Corporation
   6-7-35 Kitashinagawa; Shinagawa-ku, Tokyo, 141-0001 Japan ZHT
   [Manufacturer locale: SONY Corp., China]
   [Serial Number: 3-250-565-01]

2. SONY(®) "Sportsman Walkman" with G-Protection
   [Model Name: CD WALKMAN Model Number: unknown]
   Manufacturer Address:
   Sony Corporation
   6-7-35 Kitashinagawa; Shinagawa-ku, Tokyo, 141-0001 Japan ZHT
   [Manufacturer locale: SONY Corp., China]
   [Serial Number: unknown]

3. SONY(®) "Digital Tuner/CD Player Walkman" with G-Protection
   [Model Name: RADIO/CD WALKMAN Model Number: D-FJ210]
   Manufacturer Address:
   Sony Corporation
   6-7-35 Kitashinagawa; Shinagawa-ku, Tokyo, 141-0001 Japan ZHT
   [Manufacturer locale: SONY Corp., China]
   [Serial Number: unknown]

4. Durabrand(®) CD 855 Programmable CD player with ESP and Remote Control
   [Model Name: Durabrand CD 855 Model Number: CD 855]
   Manufacturer Address:
   Lennox Electronics, Corp.
   2 Germak Drive, Carteret, N.J. 07008
   [Manufacturer locale: Lenoxx Electronics, Corp., China]
   [Serial Number: unknown]

Tools and Materials Utilized:

1. ABS Plastic
2. One cellular telephone belt-carrying clip.
3. One piece of neoprene rubber
4. (Chemical Compound): SEM(®) 39768 part B "Problem Plastic Repair Material"
5. (Chemical Compound): Crazy Glue(™).
6. One Plastic Cutting Blade.
7. One 0.7 KW heat gun with adjustable thermal control.
8. Miniature tweezers.

Method of Manufacture:

note: The original working prototype was meant to engage one particular compact disc player model from one particular manufacturer.

1. We cut the cellular telephone's belt-carrying clip with a standard plastic cutting blade.
2. We proceeded to measure and cut the piece of ABS plastic to the proper dimensions we wanted with a standard plastic cutting blade.
3. We cut the ABS plastic to the following dimensions:
   Length: 3 inches
   Width: ½ inches
   Thickness: 1/16 inches
4. We then proceeded to remove the excess amount of ABS plastic no longer needed for the particular shape we had in mind.
5. Using a heat gun and miniature tweezers, we proceeded to shape the bottom half of the previously cut cellular telephone's belt-carrying clip. In this manner, we made it accommodate and engage in a secure manner, the bottom of the compact disc player. Using the heat gun, we molded the lower portion of the compact disc player's carrier to be accepted by the groove provided by the manufacturer of the compact disc player.
6. When we were assured this section of the device was finished to our satisfaction, we then proceeded to measure and cut the 3-inch piece of ABS plastic to the proper length needed in order to have the upper portion of the cellular telephone's belt carrying clip be accepted by the existing lip provided by the compact disc player.
7. We then proceeded to mix the two part epoxy to secure the piece of ABS plastic cut to the proper dimensions to extend the upper portion of the clip and attach it to the lower portion of the clip to accept the proper device at hand, which happened to be a compact disc player.
8. We then used a piece of rubber 1 inch-square by one-sixteenth inch thick for the prevention of any potential slippage or sliding of the compact disc player when engaged to the portable electronic information and/or entertainment rendering device carrier.
9. We then cut to the proper size the upper portion of the cellular telephone's belt-carrying clip. Using Crazy Glue(™), we glued the 1 inch-square by one-sixteenth inch thick rubber piece to this upper portion where the center base of the clip meets the compact disc player's back.
10. In turn, the upper portion of the clip did not need any modification at hand.
11. In this manner, the portable electronic information and/or entertainment rendering device carrier is finished and ready to be used for the portable compact disc player.

What we claim as our invention is as follows:

1. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum are colinear, as they lie on a common axis (A); the user engagement hook body (2) and the user engagement hook body spring (5) are not colinear with the aforementioned components; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interlace body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; Furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); the device interface body (1) attaches and detaches to and fro the compact disc player or any other portable electronic information and entertainment rendering device, the device interface body (1) is able to rotate clockwise and counterclockwise alongside the axis (A), which is perpendicular to the plane parallel to the user engagement hook body base (4), the hook base swiveling fulcrum (3), the user engagement hook body (2) and the device interface body (1).

2. A device carrier for portable compact disc players and other portable electronic information and entertainment rendering devices; the carrier is composed of six main components: a device interlace body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum are colinear, as they lie on a common axis (A); the user engagement hook body (2) and the user engagement hook body spring (5) are not colinear with the aforementioned components; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms (15) become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straighter and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); the device interface body (1) utilizes the frictional force produced by the contact between the set of upper primary device engagement hooks (11), the set of upper secondary device engagement hooks (2), the set of lower device engagement hooks (16) and the device friction rubber retainer (14), in conjunction with the elastic tension created at the set of upper device engagement arms (13) and the set of lower device engagement arms (15) at the time of engagement with the device to be carried by pushing against the tension release tab (10), thus engaging and gripping the surfaces, edges and contours of the, aforementioned, devices; disengagement is achieved by pulling on the tension release tab (10).

3. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum (3) are colinear, as they lie on a common axis (A); the user engagement hook body (2) and the user engagement hook body spring (5) are not colinear with the aforementioned components; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straighter and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus pressing against the V-shaped user engagement hook body spring (5) increasing its elastic tension; this tension is released in the form of a grip action through the user engagement hook friction surfaces (21); a carrier with a device interface body (1) that grips and pulls the portable compact disc player or any other portable electronic information and entertainment rendering devices; the simultaneous gripping and pulling action are carried out by the device interface body (1) components: a set of upper primary device engagement hooks (11), a set of upper secondary engagement hooks and (12), a set of lower device engagement hooks (16) in conjunction with the spring tension that builds up as the curvature angle C1 in the set of upper device engagement arms (13) is increased and the curvature angle C2 in the set of lower device engagement arms (15) is increased, as the arms are stretched against and over the body of the device being carried and the compression of the device against the device rubber retainer (14), takes place.

4. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16), are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16) the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); these components and their spatial arrangement allow the unhindered exchange of data storage media to and fro the portable compact disc player or any other portable electronic information and entertainment rendering devices and the operation of the controls, thereof.

5. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum (3) are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device rubber friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body (2); the other side is attached to the top most outer surface of the user engagement hook body base (4); the operational relationship amongst the components of the user engagement hook body (2) is as follows as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); a carrier consisting of a device interface body (1) able to mate with the wide variety of topologies manifested by compact disc players and other portable electronic information and entertainment rendering devices, whose dimensional physical parameters can be made at the time of manufacturing; changes can be made to the length spanning the set of upper device engagement arms (13) and the set of lower device engagement arms (16), the curvature angle C1 of the set of upper device engagement arms (13) and curvature angle C2 of the set of lower device engagement arms (16), the angle C3 between the set of lower device engagement arms (16) and the set of upper device engagement arms (13); the width of the upper and lower legs, the number of upper primary device engagement hooks (11) and upper secondary device engagement hooks (12), the number of lower device engagement hooks (16), the width, the height and curvature of such said hooks, and the width, height and length of the rubber retainer (14); also, the lower curvature length between (13) and (15) and the angle C4 between (13) and (15), the angle C5 between (15) and the curvature length between (15) and finally, the angle between (13) and the curvature length (13).

6. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body base swiveling fulcrum (3) are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook body base swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device rubber friction retainer (14) is located in the middle third of the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16) the lower device engagement arms (15) become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (10) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; the tension release tab (10) helps in the engagement and disengagement of the carrier device interface body (1) to and fro the device being carried by helping create tension at the set of upper device engagement arms (13), the set of lower device engagement arms (15) and increasing the friction between the set of upper primary device engagement hooks (11), the set of upper secondary device engagement hooks (12), the set of lower device engagement hooks (16) and the device, as the device to be carried is engaged, respectively, when the tension release tab (10) is pushed; on the other hand, when the tension release tab (10) is pulled, the elastic tension created at the set of upper device engagement arms (13), the set of lower device engagement arms (15) and the friction created between the set of upper primary device engagement hooks (11), the set of upper secondary device engagement hooks (12), the set of lower device engagement hooks (16) and the device being carried is released, respectively.

7. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the the device rubber friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) 18 closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; the rubber friction retainer (14) increases the static friction between the carrier's device interface body (1) and the device being carried, in addition, it helps to increase the elastic tension between the set of upper device engagement arms (13), the set of lower device engagement arms (15) and the device being carried and, subsequently, the static friction between the set of upper primary device engagement hooks (11), the set of upper secondary device engagement hooks (12), the set of lower device engagement hooks (16) and the device being carried, thus the gripping and pulling action is effected.

8. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interlace body (1), the user engagement hook body base (4) and the hook body swiveling fulcrum are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device rubber friction retainer (14) is located in the middle third of the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms (15) become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) 18 attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; the user engagement hook body (2) acts as the attachment and detachment mechanism for the device interface body (1) to and fro the user's body; thus, the user engagement hook body (2) prevents the device interface body (1) from being removed accidentally from the users body and allows the device carrier to carry a device attached to the user's body.

9. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base -swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum (3) are colinear, as they lie on a common axis (A); the user engagement hook body (2) and the user engagement hook body spring (5) are not colinear with the aforementioned compoments; instead, a side of the user engagement hook body spring (5) is attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook body fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); the user engagement hook body spring (5) is bound by the user engagement hook body (2), the user engagement hook body base (4) and the user engagement hook body fulcrum (6), it allows the user engagement hook body (2) to open and close relative to the user engagement hook body base (4); the user engagement hook body (2) closing and gripping strength is directly proportional to the spring strength and shape of the user engagement hook spring (2), which can be torsional, linear or wave or any combination of the aformentioned.

10. A device carrier for portable compact disc players and other portable electronic information and entertainment rendering devices; the carrier is composed of six main components: a device interface body (1), an user engagement hook body (2), a hook body base swiveling fulcrum (3), an user engagement hook body base (4), an user engagement hook body spring (5) and an user engagement hook body fulcrum (6); the device interface body (1), is attached to the user engagement hook body base (4) by means of the hook body base swiveling fulcrum (3); furthermore, the user engagement hook body (2) is attached to the user engagement hook body base (4) by means of the user engagement hook body fulcrum (6) and the user engagement hook body spring (5); the spatial relationship between the six main components is as follows: the device interface body (1), the user engagement hook body (2), the user engagement hook body base (4), the hook body base swiveling fulcrum (3) and the user engagement hook fulcrum (6) are parallel to each other, however, only the device interface body (1), the user engagement hook body base (4) and the hook body swiveling fulcrum (3) are colinear, as they lie on a common axis (A); the user engagement hook body (2) and the user engagement hook body spring (5) are not colinear with the aforementioned components; instead, a side of the user engagement hook body spring (5) 18 attached in parallel to the user engagement hook body base (4) and the other side of the user engagement hook body spring (5) is parallel to the user engagement hook body (2), thus creating a vertex or joint point between the two planes where the components lie; the user engagement hook body spring (5) side that is attached to the user engagement hook body (2) is at an angle to the plane of the device interface body (1), hook base body swiveling fulcrum (3) and, the user engagement hook body base (4); the device interface body (1) is composed of a tension release tab (10), a set of upper primary device engagement hooks (11), a set of upper secondary device engagement hooks (12), a set of upper device engagement arms (13), device friction rubber retainer (14), a set of lower device engagement arms (15), a set of lower device engagement hooks (16); furthermore, the spatial relationship amongst the device interface body (1) components is as follows: the tension release tab (10) is fused to the topmost end surface of the set of upper device engagement arms (13), which is the upper physical boundary of the device interface body (1); under the tension release tab (10) support surface, which is the topmost underside of the upper device engagement arms (13), are fused to the the upper primary device engagement hooks (11) followed by the set of upper secondary device engagement hooks (12); furthermore, moving downwards along the curve of the set of upper device engagement arms (13), the device friction retainer (14) is located in the middle third of the the device interface body (1), just before the beginning of the set of lower device engagement arms (15); the lower device engagement hooks (16) are the lowest most physical boundary on the device interface body (1) and they are fused on the inner lowest most surface of the lower device engagement arms (15); in addition, the device interface body (1) components relate to each other, operationally, as follows: when the device to be carried is first engaged in any of the existing appropriate crevices and contours, with the lower device engagement hooks (16), the lower device engagement arms become stretched, thus, straightening curvature L2 and increasing angle C2; furthermore, as the device friction rubber retainer (14) presses against the device being carried and the set of upper device engagement arms (13) become stretched as the tension release tab (10) is pushed, the curve L1 becomes straightened and the angle C1 becomes larger, thus increasing the elastic tension on the set of upper device engagement arms (13) and the friction on the set of upper primary device engagement hooks (11) and the set of upper secondary device engagement hooks (12); the user engagement hook body (2) is composed of the following components: an user engagement hook body spring (5), an user engagement hook body fulcrum (6), a set of user operation friction surfaces (20) and a set of user engagement hook friction surfaces (21); the spatial relationship amongst the components of the user engagement hook body (2) is as follows: the set of user operation friction surfaces (20), are located on the top most outer surface of the user engagement hook body (2), which is its upper most physical boundary; the set of user engagement hook friction surfaces (21) are located in the opposite lower most physical boundary of the user engagement hook body (2), the set of user engagement hook friction surfaces (21) is located in the inner surface of the user engagement hook body (2) resting against the user engagement hook body base (4); the user engagement hook body fulcrum (6) is closer in distance to the user operation friction surfaces (20); the user engagement hook body spring (5) is wrapped around the user engagement hook eody fulcrum (6) as a pivoting and support point; one side of the user engagement hook body spring (5) is attached to the inner surface of the top of the user engagement hook body base (2); the other side is attached to the top most outer surface of the user engagement hook body base (4); the operational relationship amongst the components of the user engagement hook body (2) is as follows: as the user presses the side of the user engagement hook body (2) where the user operation friction surfaces (20) are located, the user engagement hook body (2) will rotate on the axis (B) that is colinear with the user engagement hook body fulcrum (6), thus, pressing against the V-shaped user engagement hook body spring (5) increasing its elastic tension; this tension is released in the form of a grip action through the user engagement hook friction surfaces (21); the user engagement hook body (2) is endowed with a set of user operation friction surfaces (20) and a set of user engagement hook friction surfaces (21); the set of user operation friction surfaces (20) helps the user in the operation and ease of handling of the user engagement hook body (2), furthermore, the set of user engagement hook friction surfaces (21) allow the user engagement hook body (2) to obtain a better grip onto the user's clothing and allow the device carrier to keep itself attached to the user's body and with or without a device being carried.

* * * * *